US006684604B2

(12) United States Patent
Luc et al.

(10) Patent No.: US 6,684,604 B2
(45) Date of Patent: Feb. 3, 2004

(54) APPARATUS FOR CUTTING A ROW OF CAPSULES FROM A CAPSULE STRIP AND FOR FIXING THEM ON A ROW OF FILLED RECEPTACLES

(75) Inventors: Michel Luc, Chatenay Malabry (FR); Bernard Gandon, Saint-Arnould en Yvelines (FR); Daniel Pacilly, Falaise (FR)

(73) Assignee: Erca Formseal (FR)

( * ) Notice: Subject to any disclaimer, the term of this patent is extended or adjusted under 35 U.S.C. 154(b) by 0 days.

(21) Appl. No.: 10/202,282

(22) Filed: Jul. 24, 2002

(65) Prior Publication Data

US 2003/0079440 A1 May 1, 2003

(30) Foreign Application Priority Data

Jul. 26, 2001 (FR) ..... 01 09986

(51) Int. Cl.[7] ..... B65B 47/00

(52) U.S. Cl. ..... 53/282; 53/244; 53/250; 53/251; 53/513; 53/560

(58) Field of Search ..... 53/514, 513, 251, 53/250, 244, 560, 282

(56) References Cited

U.S. PATENT DOCUMENTS 2,941,341 A * 6/1960 Clinton ..... 53/514
3,279,927 A * 10/1966 Reid ..... 53/475
5,033,251 A * 7/1991 Rodriguez ..... 53/54
5,074,102 A * 12/1991 Simpson et al. ..... 53/454
5,155,981 A * 10/1992 Tordini ..... 53/559
5,391,386 A * 2/1995 Mally ..... 426/420
6,018,935 A * 2/2000 Perrone ..... 53/560

* cited by examiner

*Primary Examiner*—Rinaldi I. Rada
*Assistant Examiner*—Gloria R Weeks
(74) *Attorney, Agent, or Firm*—James Ray & Associates

(57) ABSTRACT

The invention provides apparatus for cutting out a row of capsules from a capsule strip and for fixing them on a transverse row of filled receptacles advancing stepwise in an installation for filling receptacles. The apparatus comprising: means for causing a capsule strip to advance stepwise over the path along which rows of receptacles advance; cutting means for cutting out a row of capsules from said capsule strip, said cutting means being disposed parallel to the row of receptacles to be closed and being located above said row; transfer means for transferring a row of capsules from the station for cutting out said capsules to a station for placing capsules on the receptacles to be closed in a row; fixing means for at least partially fixing the capsules that have been placed on the rims of respective ones of said receptacles; and control means for controlling said means for advancing the capsule strip stepwise, said means for cutting out capsules, said transfer means, and said fixing means, so that they operate synchronously with the means for advancing said rows of filled receptacles. The spacing of the cutting means is smaller than the spacing of the receptacles to be closed.

16 Claims, 6 Drawing Sheets

APPARATUS FOR CUTTING A ROW OF CAPSULES FROM A CAPSULE STRIP AND FOR FIXING THEM ON A ROW OF FILLED RECEPTACLES

FIELD OF THE INVENTION

The invention relates to apparatus for cutting a row of capsules from a capsule strip and for fixing them on a transverse row of filled receptacles advancing stepwise through a receptacle-filling installation.

BACKGROUND OF THE INVENTION

In installations for filling receptacles one by one, filled receptacles pass one after another through a closure station in which a capsule dispenser brings a capsule onto the receptacle for closing and the capsule is sealed to the rim of said receptacle by conventional means. As a general rule, such capsules are delivered in sachets and there arises a problem of storing and handling such sachets. However a more important problem lies with guaranteeing that the sachets and the capsules are sterile, particularly when the receptacles contain foodstuffs.

In installations that thermoform receptacles in a strip of thermoplastic-material, that fill the thermoformed receptacles, and that close the filled receptacles, it is conventional to apply a capsule strip against the strip of thermoplastic material after at least one row of receptacles has been filled, to seal the two strips together, e.g. by heat-sealing, via the rims of the filled receptacles, and then to cut through the entire thickness of both strips simultaneously so as to separate the receptacles from the strips from which they have been cut out, leaving a perforated scrap strip. In such installations, the strips advance stepwise and in each cycle at least one row of receptacles is made, rows of receptacles made during earlier cycles are filled, and the filled receptacles are sealed with the capsule strip in a subsequent cycle. Such installations are fitted with means for ensuring that the thermoplastic strip and the capsule strip are sterile, each strip being delivered from a reel.

If an installation of the above type is used for thermoforming, filling, and closing receptacles that are reentrant, i.e. receptacles in which the rim is smaller in diameter than the body, then the perforated scrap strip comprises a large amount both of thermoplastic material and of capsule strip material.

In order to avoid high levels of wastage in the capsule strip, it is tempting to use capsules that are delivered in sachets and are dispensed from a dispenser placed above each column of receptacles filled in the thermoforming and filling installation, as in installations for filling individual receptacles, in spite of all of the problems of guaranteeing sterilization as explained above.

The state of the art is illustrated by documents U.S. Pat. No. 3,509,682, U.S. Pat. No. 6,161,367, and U.S. Pat. No. 4,250,686. In all those documents, the spacing between the cutting means is equal to the spacing between the receptacles for closing in a row.

OBJECT AND SUMMARY OF THE INVENTION

The object of the invention is to propose apparatus for cutting and fixing receptacles that makes it possible to save capsule strip material.

The apparatus of the invention is particularly adapted to an installation for thermoforming receptacles from a thermoplastic strip, for filling the thermoformed receptacles, and for closing the filled receptacles, in particular when the receptacles are reentrant, having rims of diameter smaller than the diameter of their bodies.

The apparatus of the invention is also applicable to closing individual receptacles placed in transverse rows that are advanced stepwise, particularly in an installation for thermoforming receptacles from precut shapes and for filling the thermoformed receptacles.

The invention thus provides apparatus comprising:

- means for causing a capsule strip to advance stepwise over the path along which rows of receptacles advance;
- cutting means for cutting out a row of capsules from said capsule strip, said cutting means being disposed parallel to the row of receptacles for closing and above said row;
- transfer means for transferring a row of capsules from the station where said capsules are cut out to a station for placing capsules on the receptacles for closing in a row;
- fixing means for fixing at least partially the capsules placed on the respective rims of said receptacles; and
- control means for controlling said means for advancing the capsule strip stepwise, said means for cutting out capsules, said transfer means, and said fixing means so that they operate synchronously with the means for advancing said rows of filled receptacles.

According to the invention, in the apparatus the spacing of the cutting means is smaller than the spacing of the receptacles to be closed, and the transfer means co-operate with cam paths.

The fact that the capsules are taken from a capsule strip makes it easier to maintain capsule sterility.

In addition, the size of the advance step of the capsule strip is independent of the size of the advance step of the rows of receptacles, thus making it possible to reduce wastage in the longitudinal direction of the capsule strip.

In order to achieve further savings of material in the capsule strip, and according to an advantageous characteristic of the invention, the path along which the capsule strip advances is oblique relative to the cutting means for cutting out a row of capsules.

For example, the path along which the capsule strip advances is at an angle of about 60E relative to the cutting means.

Preferably, the size of the advance step of the capsule strip is substantially equal to the spacing of the cutting means.

The spacing of the cam paths in the zone situated facing the cutting station for cutting out the capsules is equal to the spacing of the cutting means, and the spacing of the cam paths in the zone situated facing the capsule-placing station is equal to the spacing of the receptacles to be closed.

In a preferred embodiment of the invention, the transfer means for transferring a row of capsules comprise:

- at least one row of parallel holding tubes carried by a cylinder mounted to turn about a support shaft placed facing the cutting station for cutting out capsules and over the station for placing capsules, the free ends of said tubes being suitable for holding the capsules by suction;
- means for causing said cylinder to turn stepwise between a position for taking hold of capsules in which the tubes of said row face the cutting means and a position for placing capsules in which said tubes face downwards and their free ends are in the vicinity of the receptacles to be closed; and
- means for putting said tubes into communication with a vacuum source while they are holding capsules and transferring them from the cutting station for cutting out the capsules to the placing station, and for putting them into communication with exhaust while the capsules are being placed on the receptacles to be closed.

Preferably, the transfer means further comprise means for moving the support shaft towards the cutting means while the cylinder is in its position for taking hold of a row of capsules, and downwards while the cylinder is in its position for placing capsules so as to enable capsules to be put into position on the rims of the receptacles.

According to an advantageous characteristic, the cylinder has a plurality of rows of tubes disposed along generator lines that are regularly distributed angularly at the periphery of said cylinder and in such a manner that when a row of tubes is in its position for taking hold of capsules, another row of tubes is in its position for placing capsules, said cylinder turning stepwise in the same direction during each cycle.

Preferably, the position for taking hold of capsules is diametrically opposite the position for placing them about the support shaft of the cylinder.

According to another advantageous characteristic, the tubes in a row are slidably mounted independently of one another along respective guide shafts secured to the cylinder and parallel to the support shaft, each tube having a shoe guided by a cam path that is fixed relative to the support shaft of the cylinder.

Preferably, the means for at least partially fixing the capsules that have been placed on the respective rims of the row of receptacles to be closed comprise a set of arms that are substantially parallel to the advance direction of the rows of receptacles to be closed and carried by a shaft disposed above the path along which said rows of receptacles advance, the free ends of intermediate arms in said set of arms being disposed between the receptacles to be closed and the free ends of the extreme arms being disposed outside the extreme receptacles to be closed, said shaft being suitable for pivoting between a high position in which said arms release a passage for the transfer means while transferring a row of capsules, and a low position in which the ends of the arms bear against the side edges of the capsules placed on the rims of the receptacles to be closed, said ends of the arms including means for fixing spots of said capsules to the rims of the corresponding receptacles in co-operation with backing tools disposed beneath the side rims of the receptacles to be closed. Most advantageously, the backing tools are stationary.

BRIEF DESCRIPTION OF THE DRAWINGS

Other characteristics and advantages of the invention appear on reading the following description given by way of example and made with reference to the accompanying drawings, in which.

MORE DETAILED DESCRIPTION

Figure 1:
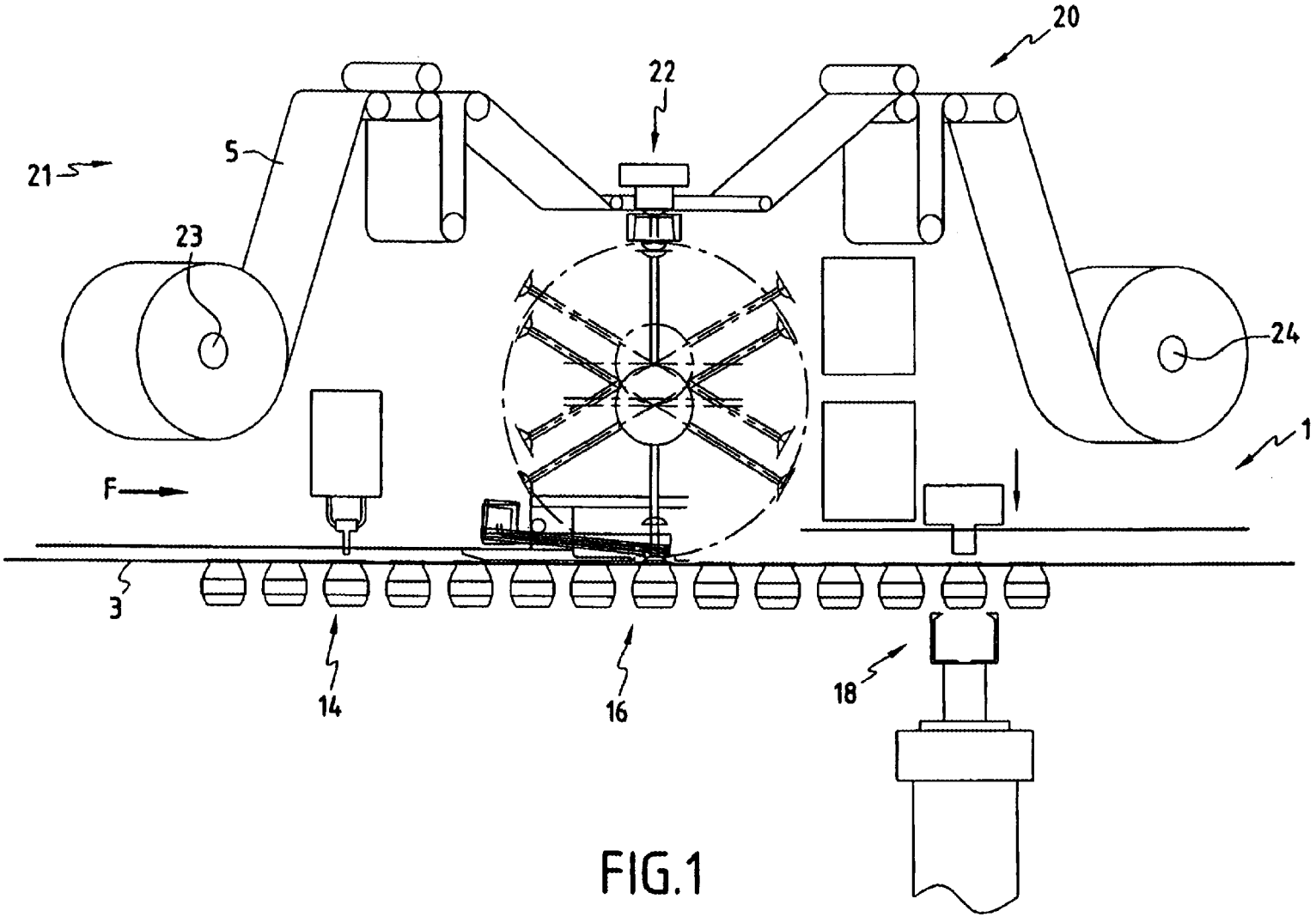
FIG. 1 is a diagrammatic side view of an installation for filling rows of receptacles that are advanced stepwise, and the installation is fitted with apparatus in accordance with the invention for cutting out a row of capsules and for fixing said capsules onto the rims of the receptacles.
Figure 2:
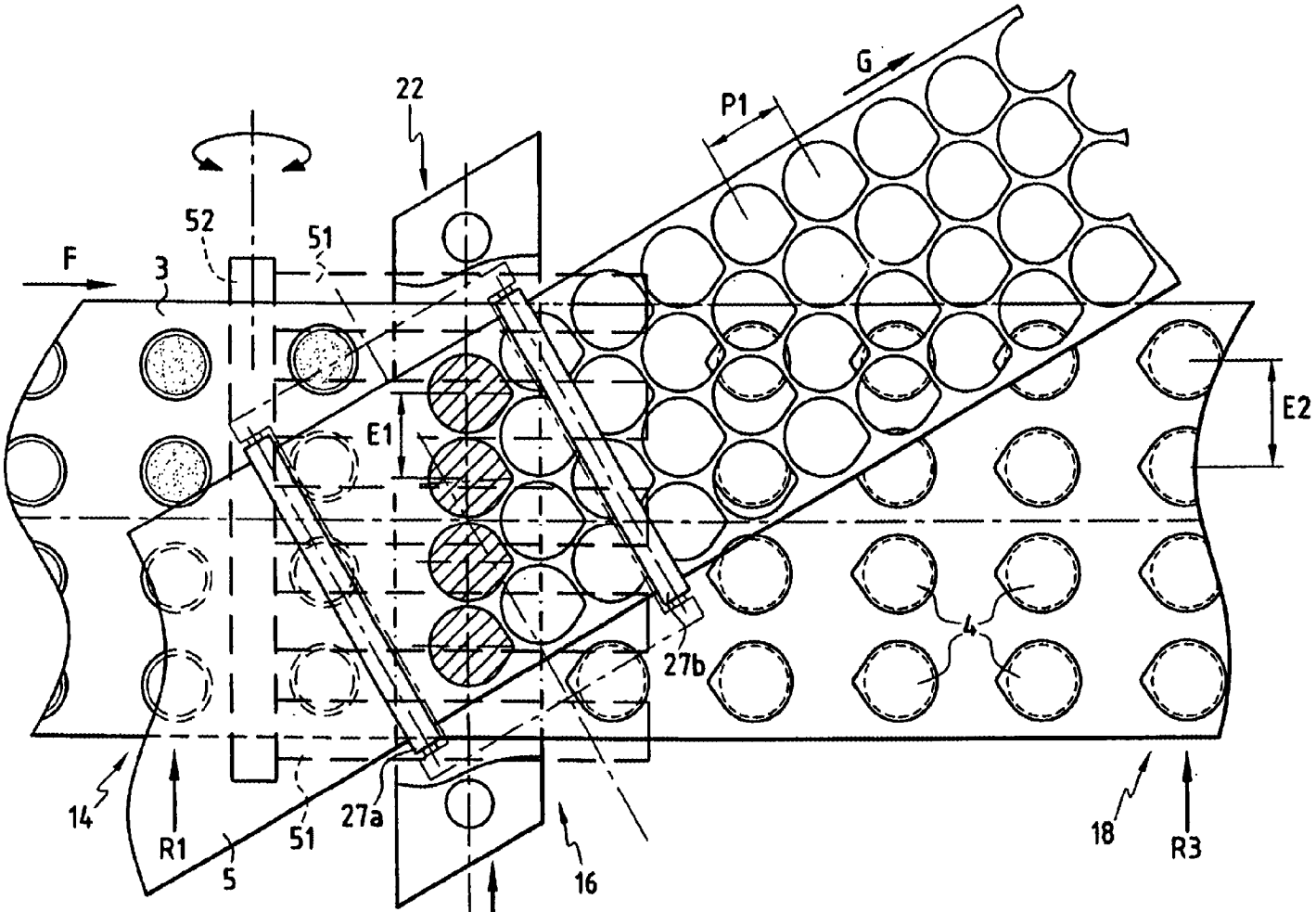
FIG. 2 is a plan view of the installation and the apparatus of the invention.

FIGS. 1 and 2 show a portion of an installation 1 for filling a transverse row of receptacles 2, e.g. made by thermoforming a strip of thermoplastic material 3, the receptacles being filled with a substance that is liquid, semiliquid, or gelatinous, and in particular with a foodstuff, the installation then closing the filled receptacles of said row by means of capsules 4 taken from a capsule strip 5 by means of apparatus 20 of the invention.

Figure 7:
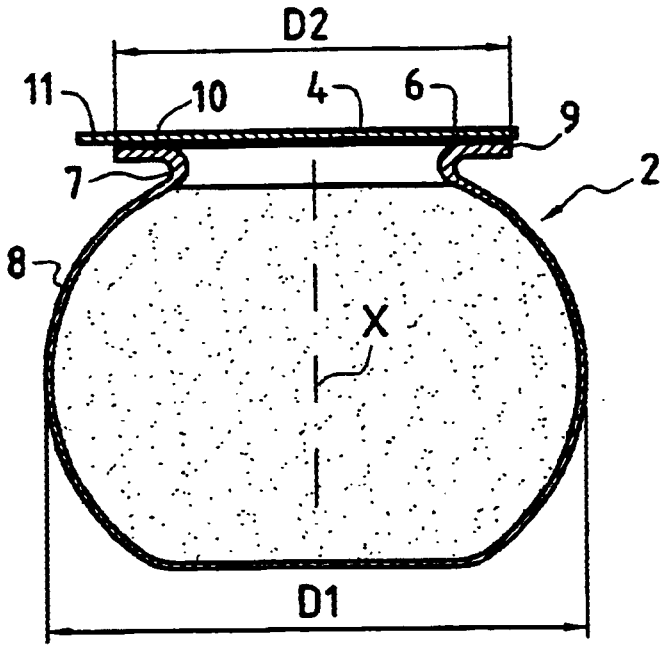
FIG. 7 is a section view on a plane of symmetry through a filled and closed receptacle.
Figure 8:
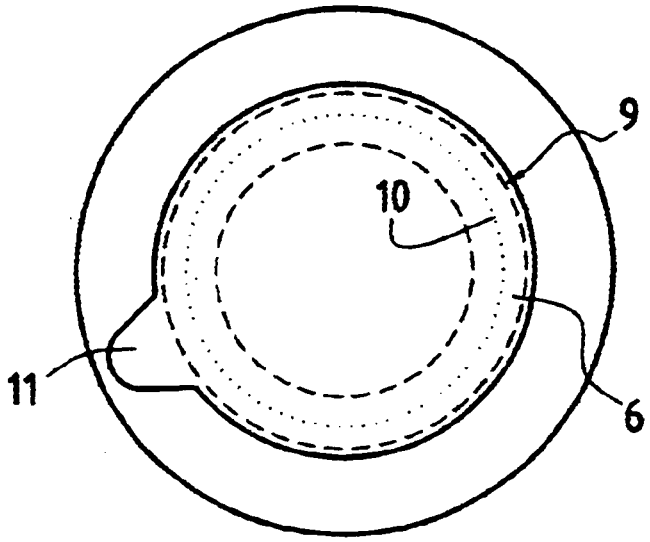
FIG. 8 is a plan view of the FIG. 7 receptacle.

The receptacles 2 shown in detail in FIGS. 7 and 8 are reentrant receptacles, for example, having rims 6 lying in the horizontal plane of the path along which the thermoplastic strip 3 travels, said rims being connected via respective necks 7 to receptacle bodies 8 of diameter D1 greater than the diameter D2 of the periphery 9 of the rim 6 of a receptacle 2.

Each filled and closed receptacle carries a capsule 4 fixed to its rim 6 via a continuous bead of heat-sealing 10. The capsule 4 is of a diameter that is not less than the diameter D2 of the periphery 9 of the receptacle 2 and it may present a pull tab 11 for making it easier to open the receptacle 2. The tab 11 extends radially outwards from the periphery 9 of the receptacle 2, as can be seen in FIGS. 7 and 8. The receptacles 2 may be circularly symmetrical about a vertical axis X, but they may also have a horizontal section that is not circular.

When reentrant receptacles are made by thermoforming in the installation 1, the peripheries 9 of the rims 6 of the receptacles 2 are precut prior to the thermoforming via discontinuous lines interrupted by bridges which are subsequently broken by shearing in a station for separating the receptacles 2 after the capsules 4 have been sealed.

The apparatus 20 described below can also be adapted to an installation for filling individual receptacles placed in rows and columns and advancing stepwise through the installation in the direction of arrow F, the rows extending perpendicularly to the direction of arrow F.

The installation 1 essentially comprises: means for causing the thermoplastic strip to advance stepwise, or for causing a row of individual receptacles to advance stepwise in the direction of arrow F; a station 14 for filling a row $R_1$ of receptacles; a station 16 for placing and fixing a row of capsules on a previously filled row $R_2$ of receptacles by means of the apparatus 20 of the invention; a station 18 for sealing the capsules 4 to the receptacles in a row $R_3$; and means for causing the various tools of the installation to operate synchronously. The stations 14, 16, and 18 extend from upstream to downstream in the direction of arrow F.

It should be observed that the rows $R_1$, $R_2$, and $R_3$ mentioned above are not necessarily adjacent, they could be separated by other rows of receptacles that have been filled or closed, depending on the amount of room available for installing the various filling and sealing tools, and also for installing the apparatus 20.

The apparatus 20 as shown in FIGS. 1 to 6 is located above the path along which the rows $R_1$, $R_2$, and $R_3$ of receptacles are advanced.

The apparatus essentially comprises means 21 for causing a capsule strip 5 to advance stepwise synchronously with the installation 1 through a station 22 for cutting out a row of capsules. The capsule strip 5 is unreeled from a reel 23, moves horizontally in the direction of an arrow G through the cutting station 22, and the strip of waste is recovered in a second reel 24.

As can be seen clearly in FIGS. 1 and 2, the cutting station 22 is located above the station 16 for placing the capsules on the receptacles 2 in the row $R_2$, and parallel to said row.

Above the capsule strip 5, the apparatus comprises a set of vertically movable tools 25 for cutting out capsules, which tools co-operate with backing tools 26 beneath them, which backing tools are optionally movable vertically while cutting out a row of capsules. The backing tools 25 are in the form of sleeves having top orifices of outline matching the outline of the capsule 4 to be cut out together with its pull tab 11. The outline of the cutting tools is complementary to that of the orifices of the sleeves. The outlines of the sleeve orifices in horizontal planes flare downwards so as to enable the capsules 4 that have been cut out by the tools 25 to be extracted as explained below. References 27*a* and 27*b* designate two rollers for driving the capsule strip, said rollers being disposed horizontally and extending perpendicularly to the travel direction G of the capsule strip 5 and defining the horizontal path along which the capsule strip 5 advances through the station 22 for cutting out the capsules 4.

As can be seen in FIG. 1 and above all in FIG. 2, the capsule strip 5 moves horizontally through the cutting station 22 in the direction of arrow G, which direction is oblique relative to the travel direction of the rows of receptacles $R_1$, $R_2$, and $R_3$ as defined by arrow F.

In contrast, the station 22 for cutting out capsules and the station 16 for placing capsules on the receptacles are both perpendicular to the travel direction of the rows of receptacles. It can also be seen in FIG. 2 that the spacing $E_1$ of the cutting tools 25 is smaller than the spacing $E_2$ of the receptacle 2 in a given row, i.e. smaller than the spacing of the columns of receptacles passing through the installation 1. This disposition makes it possible to reduce wastage in the strip of straps coming from the capsule strip 5 after rows of capsules have been cut out. In addition, assuming the capsules 4 are substantially circular, the size of the advance step $P_1$ of the capsule strip 5 during each cycle is substantially equal to the spacing $E_1$ of the cutting tools 25.

Advantageously, the path along which the capsule strip 5 advances as defined by arrow G is at an angle of 60E to the direction in which the tools 25 and 26 in the capsule cutting station 22 are aligned. The number of capsules 4 that are cut out in a single cycle is naturally equal to the number of receptacles 2 constituting a row.

The apparatus 20 also has means 30 for transferring a row of cutout capsules from the cutting station 22 to the station 16 where a row of capsules 4 is placed on the receptacles 2 in the row $R_2$. These transfer means 30 which are shown in detail in FIGS. 3 and 4 comprise a plurality of pairs of rows of diametrically opposite tubes 31*a*, 31*b* placed on generator lines that are regularly spaced apart angularly at the periphery of a cylinder 32 capable of turning stepwise about a support shaft 33 carried by uprights 33*a*, 33*b* disposed on either side of the path along which the thermoplastic strip 3 advances.

Figure 3:
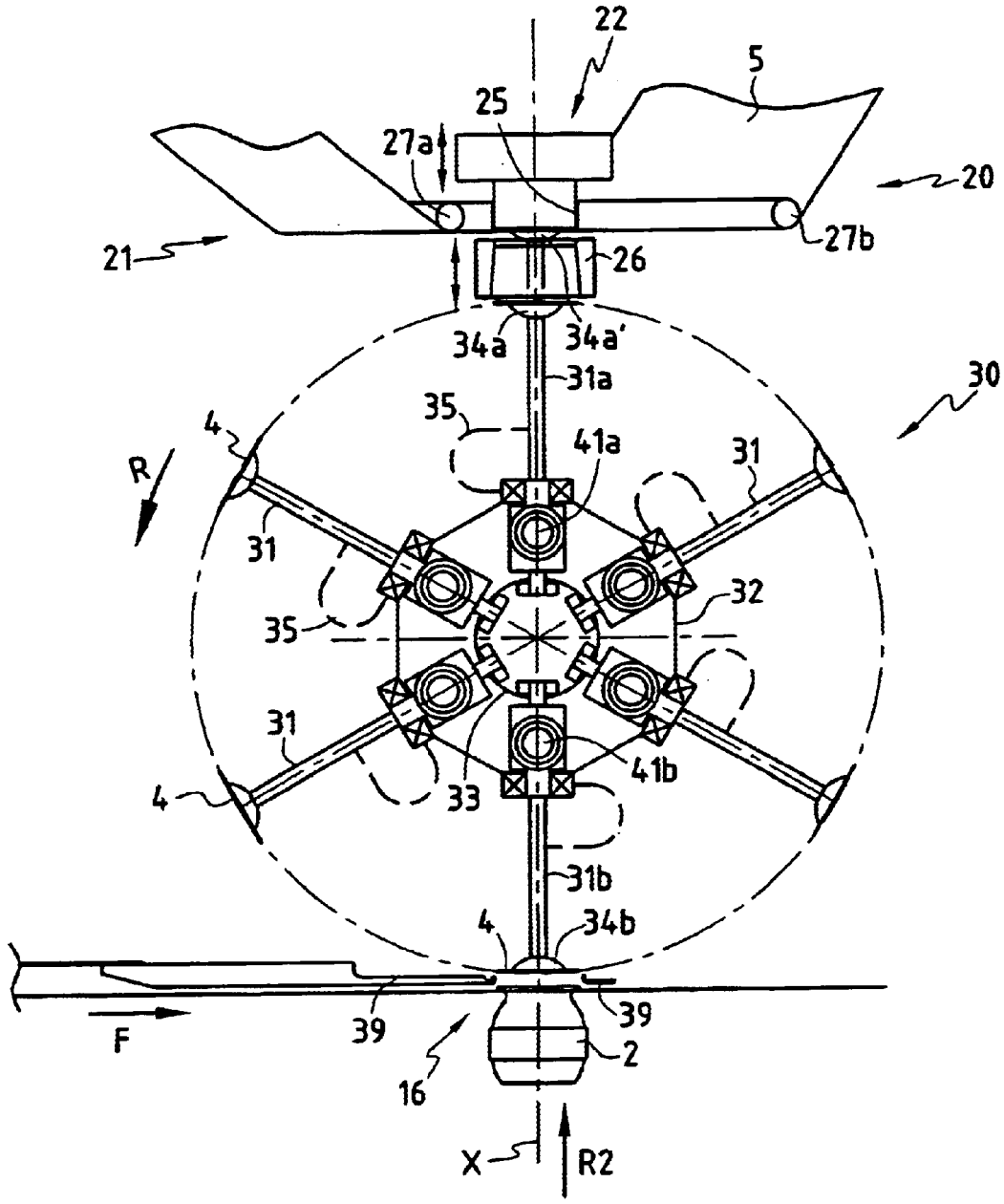
FIG. 3 is a side view on a larger scale showing the means for cutting the capsule strip and the means for transferring a row of capsules onto a row of receptacles placed in a station for receiving and fixing capsules.

As can be seen in FIG. 3, the cylinder 32 comprises, for example, three opposite pairs of rows of tubes 31*a*, 31*b* and the cylinder 32 turns through 60E on each cycle in the direction of arrow R, and in such a manner that when cutting out a row of capsules in the cutting station 22, a row of tubes referenced 31*a* is on top of the cylinder in register with the bottom orifices of the sleeves 26, while the row of tubes 31*b* is at the bottom of the cylinder in register with the station 16 for placing the capsules.

The support shaft 33 is parallel to the row $R_2$ of receptacles and to the row of cutting tools 25, and it is located substantially halfway between the rims 6 of the receptacles 2 in the row $R_2$ and the sleeves 26 so as to enable the cylinder 32 to rotate stepwise in the direction of arrow R.

The tubes 31*a* and 31*b* extend radially at the periphery of the cylinder 32 and their outer ends are fitted with suction cups 34*a*, 34*b* enabling the capsules that have been cut out in the cutting station to be held by suction. Reference 35 designates hoses that serve to put the bores of the tubes 31*a* and of the tubes on the left in FIG. 3 into communication with a vacuum source 36 and for putting the tubes 31*b* and the tubes situated to the right in FIG. 3 into communication with an exhaust or with a source of pressure 37, via a rotary joint 38 mounted on the support shaft 33 and shown in FIG. 4, said source and said exhaust forming parts of a conventional pneumatic circuit that does not require further explanation.

The support shaft 33 is vertically movable from its mean position in which the cylinder 32 is free to turn. It can move firstly to a low position for placing capsules 4 onto the rims 6 of the receptacles 2 in the station 16, in which position the suction cups 34*b* of the tubes 31*b* move down onto the receptacles 2 and take up the position referenced 34*b* ' in FIGS. 5 and 6, and secondly to a high position while the capsules are being cut out in the cutting station 22, in which position the suction cups 34*a* of the tubes 31*a* penetrate into the top orifices of the sleeves 26, taking up the position referenced 34*a*' in FIG. 3, where they take hold of the cutout capsules by suction. In this position, the suction cups 34*b* of the tubes 31*b* rise into the position referenced 34*b*" in FIGS. 5 and 6.

Figure 5:
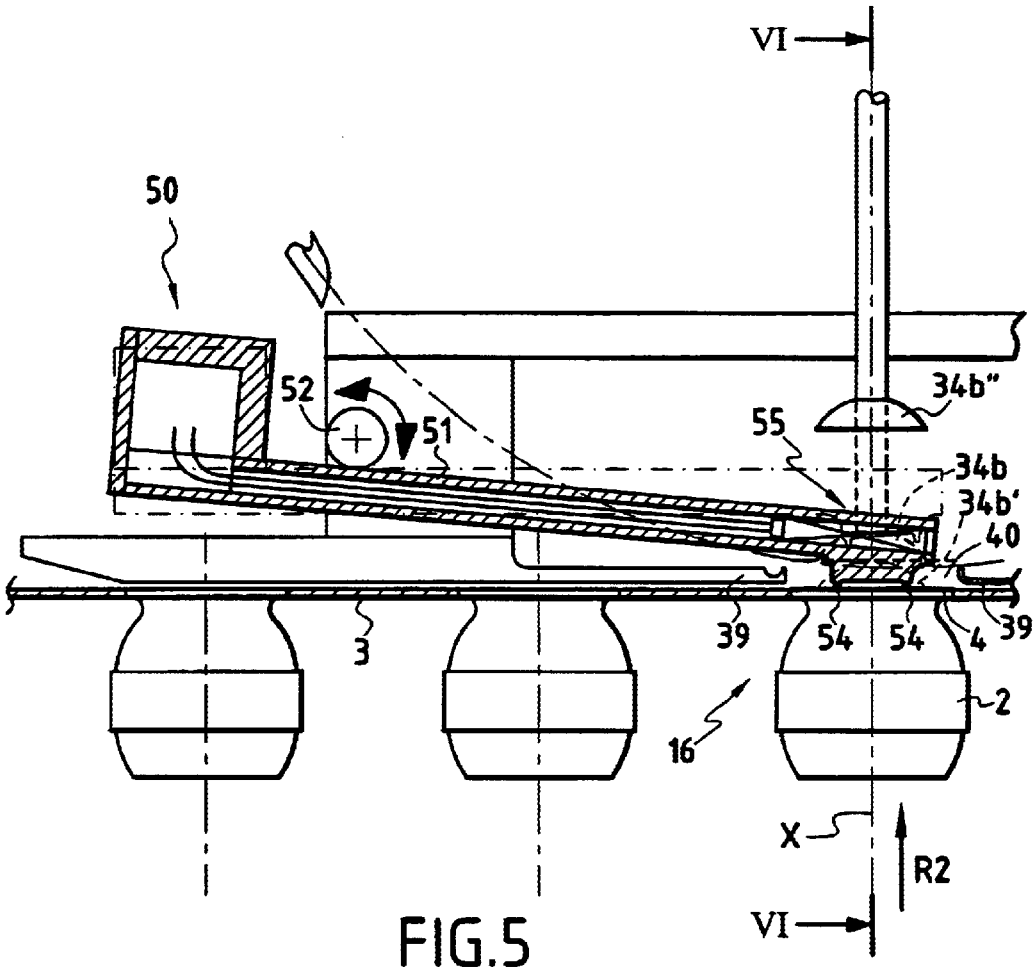
FIG. 5 is a side view of means for fixing the capsules via spots.
Figure 6:
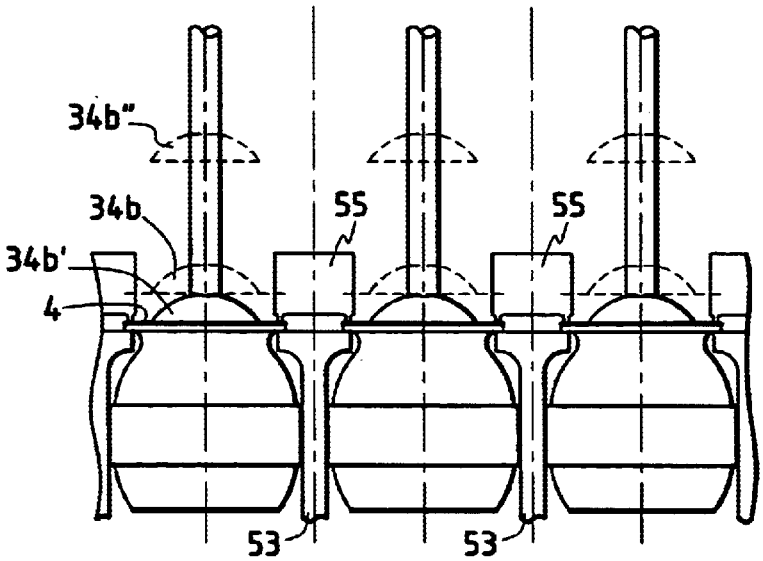
FIG. 6 is an end view on line VI—VI of FIG. 5.

Reference 39 visible in FIGS. 3 and 5 designates a plate situated in the cutting station above the receptacles 2 and below the pivot path of the suction cups 34*b*, having orifices 40 matching the section of the capsules 4 and enabling the capsules 4 that are brought in by the suction cups 34*b* to be centered.

When the bottom suction cups 34*b* have been brought over the orifices 40 by turning the cylinder 32, the tubes 31*b* are connected to the exhaust and the capsules 4 previously held by said suction cups 34*b* tend to drop into the orifices 40.

At the same time, the suction cups 34*b* are moved towards the position 34*b*' beneath the orifices 40 to apply a very small amount of force on the capsules 4 which have already been centered by the orifices 40 that are accurately positioned above the rims 6 of the receptacles in the row $R_2$. During this operation, the suction cups 34*a* of the top tubes 31*a* also move downwards.

Thereafter, the support shaft 33 is raised towards its high position and the suction cups 34*a* in the position referenced 34*a*' suck in the capsules that are being cut out. The top tubes 31*a* are maintained under suction during three cycles, in the example shown in the drawings, until they reach the bottom position of the cylinder 32.

Figure 4:
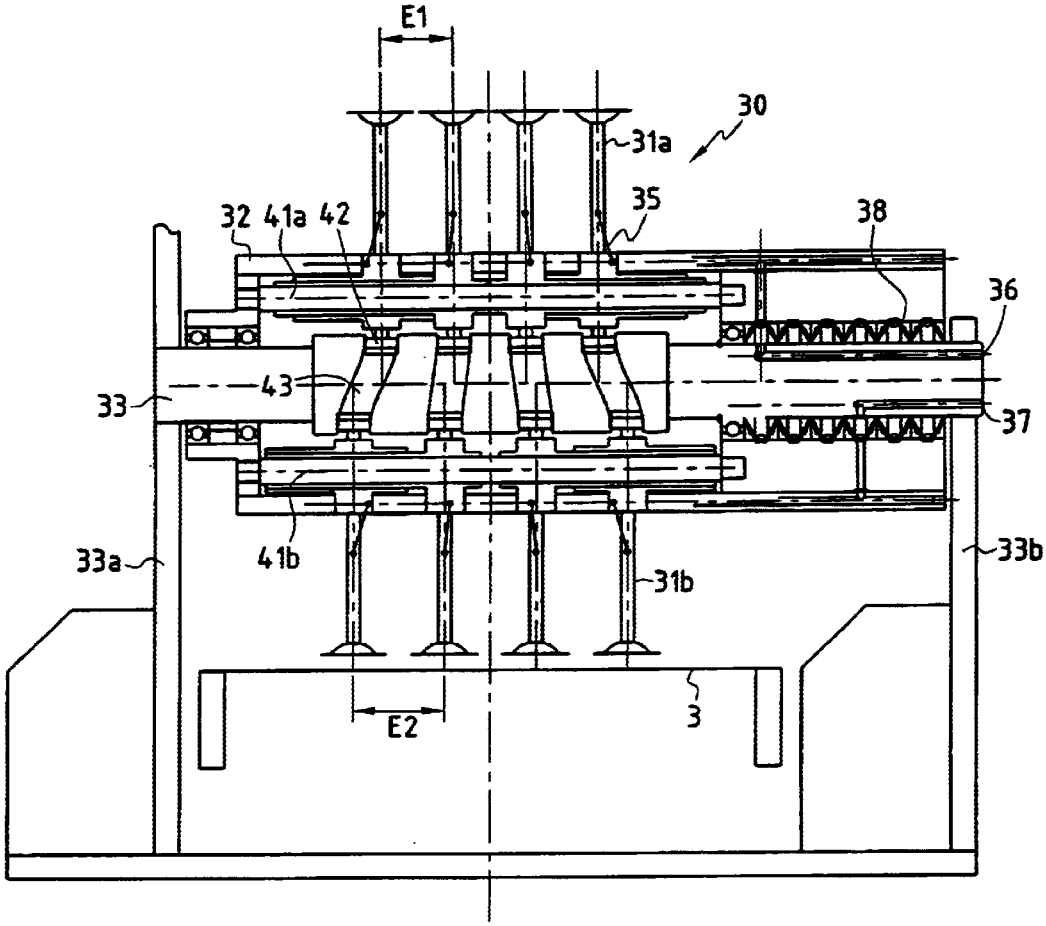
FIG. 4 is an end view of the capsule transfer means.

In order to enable the spacing between two adjacent tubes 31 in a row of tubes to vary between the value $E_1$ and the value $E_2$ as shown in FIG. 2, the tubes in each row of tubes are slidably mounted as can be seen in FIGS. 3 and 4, the tubes sliding independently of one another along a respective guide shaft 41*a* for the tubes 31*a*, and 41*b* for the tubes 31*b*, their axes being parallel to the support shaft 33, and each tube 31 has an inner shoe fitted with a cam-follower wheel 42 that is guided axially along the periphery of the support shaft 33 by a cam path 43.

The installation 1 shown in the drawings has four columns of receptacles disposed in rows.

Each row of tubes also has four tubes 31 and the periphery of the support shaft 33 has four cam paths 43 which are spaced apart in the top zone of the support shaft 33 by a distance equal to $E_1$ and that are spaced apart in the bottom zone of the support shaft 33 by a distance equal to $E_2$. The tubes 31 are caused to slide along their guide shafts 41*a* or 41*b* in conventional manner by means of bushings and slideways.

The apparatus 20 of the invention also comprises means 50 for causing the capsules 4 that have been placed on the rims 6 of the receptacles 2 in the row $R_2$ in the station 16 to be fixed thereto, at least in part. These means 50 can be seen in FIGS. 5 and 6. They essentially comprise a set of arms 51 extending parallel to the direction F in which the rows of receptacles are displaced, and placed immediately above the path along which the receptacles advance. These arms 51 are supported by a shaft 52 capable of pivoting between a high position in which the ends 55 of the arms 51 are above the suction cups 34*b*, and a low position in which the ends 55 of the arms 51 fix the capsules that have been placed on the receptacles 2 in the station 16.

In the installation 1 shown in the drawings and having four columns of receptacles, there are five arms 51, with the end arms lying outside the outer columns and with the three intermediate arms being disposed between respective pairs of adjacent columns of receptacles.

The ends 55 of the arms 51 are situated above the capsule-placing station 16.

Each arm 51 is of a width that is narrow enough to allow a suction cup carrying a capsule to pass between two adjacent arms 51 while transferring the capsules. The ends 55 of the arms are broader than the gap between two adjacent capsules as deposited by the tubes 31*b* on the receptacles 2 in the station 16. The bottom faces of these ends 55 have means for fixing the capsules 4 to the rims 6 of the receptacles in the station 16 via fixing spots achieved by co-operating with preferably fixed backing tools 53 located between the columns of receptacles and outside the outer columns. When the receptacles 2 are made of thermoplastic material, the fixing means can be constituted by hot studs 54, for example so that by pressing on the side edges of the capsules 4 placed on the rims 6 of the receptacles they establish fixing spots between the capsules 4 and the rims 6 of the receptacles by melting the thermoplastic material.

The ends 55 of the intermediate arms 51 carry four studs 54, for example, two of which fix the capsule on the receptacle in the right-hand column and the other two of which fix the left-hand capsule on the corresponding receptacle, with the ends 55 of the outer arms thus having only two studs 54 each.

Final sealing of the capsules 4 on the receptacles 2 is performed in a subsequent cycle in the sealing station 18, where continuous beads of heat-sealing 10 are provided.

We claim:

1. Apparatus for cutting out a row of capsules in a capsule strip and for fixing them on a transverse row of filled receptacles advancing stepwise through an installation for filling receptacles, the apparatus comprising:

means for causing a capsule strip to advance stepwise over the path along which rows of receptacles advance;

cutting means for cutting out a row of capsules from said capsule strip, said cutting means being disposed parallel to the row of receptacles for closing and above said row;

transfer means for transferring a row of capsules from the station where said capsules are cut out to a station for placing capsules on the receptacles for closing in a row;

fixing means for fixing at least partially the capsules placed on the respective rims of said receptacles; and control means for controlling said means for advancing the capsule strip stepwise, said means for cutting out capsules, said transfer means, and said fixing means so that they operate synchronously with the means for advancing said rows of filled receptacles, wherein the spacing of the cutting means is smaller than the spacing of the receptacles to be closed, and wherein the transfer means cc-operate with cam paths.

2. Apparatus according to claim 1, wherein the path along which the capsule strip advances is oblique relative to the cutting means for cutting out a row of capsules.

3. Apparatus according to claim 2, wherein the path along which the capsule strip advances is at an angle of about 60E relative to the cutting means.

4. Apparatus according to claim 1, wherein the size of the advance step of the capsule strip is substantially equal to the spacing of the cutting means.

5. Apparatus according to claim 1, wherein the spacing of the cam paths in the zone situated facing the cutting station for cutting out the capsules is equal to the spacing of the cutting means, and the spacing of the cam paths in the zone situated facing the capsule-placing station is equal to the spacing of the receptacles to be closed.

6. Apparatus according to claim 1, wherein the transfer means for transferring a row of capsules comprise:

at least one row of parallel holding tubes carried by a cylinder mounted to turn about a support shaft placed facing the cutting station for cutting out capsules and over the station for placing capsules, the free ends of said tubes being suitable for holding the capsules by suction;

means for causing said cylinder to turn stepwise between a position for taking hold of capsules in which the tubes of said row face the cutting means and a position for placing capsules in which said tubes face downwards and their free ends are in the vicinity of the receptacles to be closed; and means for putting said tubes into communication with a vacuum source while they are holding capsules and transferring them from the cutting station for cutting out the capsules to the placing station, and for putting them into communication with exhaust while the capsules are being placed on the receptacles to be closed.

7. Apparatus according to claim 6, wherein the transfer means further comprise means for moving the support shaft towards the cutting means while the cylinder is in its position for taking hold of a row of capsules, and downwards while the cylinder is in its position for placing capsules so as to enable capsules to be put into position on the rims of the receptacles.

8. Apparatus according to claim 6, wherein the cylinder has a plurality of rows of tubes disposed along generator lines that are regularly distributed angularly at the periphery of said cylinder and in such a manner that when a row of tubes is in its position for taking hold of capsules, another row of tubes is in its position for placing capsules, said cylinder turning stepwise in the same direction during each cycle.

9. Apparatus according to claim 8, wherein the position for taking hold of capsules is diametrically opposite the position for placing them about the support shaft of the cylinder.

10. Apparatus according to claim 6, wherein the tubes in a row are slidably mounted independently of one another along respective guide shafts secured to the cylinder and parallel to the support shaft, each tube having a shoe guided by a cam path that is fixed relative to the support shaft of the cylinder.

11. Apparatus according to claim 1, wherein the means for at east partially fixing the capsules that have been placed on the respective rims of the row of receptacles to be closed comprise a set of arms that are substantially parallel to the advance direction of the rows of receptacles to be closed and carried by a shaft disposed above the path along which said rows of receptacles advance, the free ends of intermediate arms in said set of arms being disposed between the receptacles to be closed and the free ends of the extreme arms being disposed outside the extreme receptacles co be closed, said shaft being suitable for pivoting between a high position in which said arms release a passage for the transfer means while transferring a row of capsules, and a low posit ion in which the ends of the arms bear against the side edges of the capsule placed on the rims of the receptacles to be closed, said ends of the arms including means for fixing spots of said capsules to the rims of the corresponding receptacles in co-operation with backing tools disposed beneath the side rims of the receptacles to be closed.

12. Apparatus according to claim 11, wherein the backing tools are stationary.

13. Apparatus according to claim 1, the apparatus being associated with an installation for thermoforming and filling receptacles from a strip of thermoplastic material.

14. Apparatus according to claim 13, wherein the installation for thermoforming and filling receptacles makes receptacles that are reentrant.

15. Apparatus according to claim 14, wherein the receptacle comprises a body and a rim connected to the body by a neck, said rim having a diameter smaller than the diameter of the body.

16. Apparatus according to claim 1, the apparatus being associate with an installation for thermoforming receptacles from shapes that have been previously cut out and for filling the thermoformed receptacles.

* * * * *